US011380252B2

(12) United States Patent
Kymissis et al.

(10) Patent No.: US 11,380,252 B2
(45) Date of Patent: Jul. 5, 2022

(54) ADDRESSING FOR EMISSIVE DISPLAYS

(71) Applicant: LUMIODE, INC., Bronx, NY (US)

(72) Inventors: Ioannis Kymissis, New York, NY (US); Yu-Jen Hsu, New York, NY (US); Vincent Lee, New York, NY (US); Brian Tull, New York, NY (US)

(73) Assignee: LUMIODE, INC., Bronx, NY (US)

( * ) Notice: Subject to any disclaimer, the term of this patent is extended or adjusted under 35 U.S.C. 154(b) by 0 days.

(21) Appl. No.: 17/416,221

(22) PCT Filed: Dec. 17, 2019

(86) PCT No.: PCT/US2019/066888
§ 371 (c)(1),
(2) Date: Jun. 18, 2021

(87) PCT Pub. No.: WO2020/131894
PCT Pub. Date: Jun. 25, 2020

(65) Prior Publication Data

US 2022/0059020 A1 Feb. 24, 2022

Related U.S. Application Data

(60) Provisional application No. 62/783,714, filed on Dec. 21, 2018.

(51) Int. Cl.
*G09G 3/32* (2016.01)

(52) U.S. Cl.
CPC ..... *G09G 3/32* (2013.01); *G09G 2300/0819* (2013.01); *G09G 2310/0286* (2013.01); *G09G 2310/08* (2013.01)

(58) Field of Classification Search
CPC ..... G09G 3/32; G09G 2300/0819; G09G 2310/0286; G09G 2310/08
See application file for complete search history.

(56) References Cited

U.S. PATENT DOCUMENTS 5,475,397 A 12/1995 Saidi
5,654,734 A 8/1997 Orlen et al.
(Continued)

FOREIGN PATENT DOCUMENTS

EP 2835802 A1 2/2015
JP 2006196712 A 7/2006
(Continued)

OTHER PUBLICATIONS

International Search Report and Written Opinion for PCT/US2019/033554 dated Sep. 11, 2019 in 13 pages.
(Continued)

*Primary Examiner* — Muhammad N Edun
(74) *Attorney, Agent, or Firm* — Cozen O'Connor

(57) ABSTRACT

Addressing an emissive display having pixels arranged into rows and columns. A first clock signal is received at an address select input of a first row of the display. Data signals are received at data signal inputs of the first row of the display, each of the received data signals corresponding to a column of the display. When the first clock signal is active at the address select input, the data signals are output to corresponding drivers of light emitting semi-conductors of the first row and via corresponding data signal outputs of the first row. The data signals are received from the data signal outputs of the first row at a first row of shift registers. A second clock signal is received at the first row of shift registers. When the second clock signal is active, the data signals are output from the first row of shift registers.

23 Claims, 5 Drawing Sheets

(56) References Cited

U.S. PATENT DOCUMENTS

| | | | | |
|---|---|---|---|---|
| 7,928,465 | B2 | 4/2011 | Lee et al. | |
| 8,493,000 | B2 | 7/2013 | Jungwirth | |
| 8,493,309 | B2 | 7/2013 | Tobita | |
| 8,664,686 | B2 | 3/2014 | Shieh et al. | |
| 8,681,185 | B2 | 3/2014 | Guncer | |
| 8,907,591 | B2 | 12/2014 | Jungwirth | |
| 9,041,034 | B2 | 5/2015 | Mao et al. | |
| 9,147,812 | B2 | 9/2015 | Andrews | |
| 9,159,700 | B2 | 10/2015 | Sakariya et al. | |
| 9,196,606 | B2 | 11/2015 | Oraw | |
| 9,203,005 | B2 | 12/2015 | Lee et al. | |
| 9,240,397 | B2 | 1/2016 | Bibl et al. | |
| 9,515,238 | B2 | 12/2016 | Maaskant et al. | |
| 9,530,949 | B2 | 12/2016 | Lee et al. | |
| 9,548,332 | B2 | 1/2017 | Hu et al. | |
| 9,557,954 | B2 | 1/2017 | Jepsen et al. | |
| 9,558,721 | B2 | 1/2017 | Sakariya et al. | |
| 9,570,427 | B2 | 2/2017 | Bibl et al. | |
| 9,805,820 | B2 * | 10/2017 | In | G09G 3/20 |
| 9,812,494 | B2 | 11/2017 | Percival | |
| 2010/0164854 | A1 | 7/2010 | Kim et al. | |
| 2010/0317132 | A1 | 12/2010 | Rogers et al. | |
| 2010/0321640 | A1 | 12/2010 | Yeh et al. | |
| 2012/0025242 | A1 | 2/2012 | Zeng et al. | |
| 2012/0286240 | A1 | 11/2012 | Yu et al. | |
| 2014/0103391 | A1 | 4/2014 | Haruta et al. | |
| 2014/0145204 | A1 | 5/2014 | Xu et al. | |
| 2014/0368561 | A1 | 12/2014 | Liao et al. | |
| 2015/0279902 | A1 | 10/2015 | Von Malm et al. | |
| 2015/0332635 | A1 | 11/2015 | Lau et al. | |
| 2016/0210892 | A1 * | 7/2016 | Ohara | G09G 3/3266 |
| 2016/0308103 | A1 | 10/2016 | Hu et al. | |
| 2017/0025399 | A1 | 1/2017 | Takeya et al. | |
| 2017/0179097 | A1 | 6/2017 | Zhang et al. | |
| 2017/0179192 | A1 | 6/2017 | Zhang et al. | |
| 2017/0271557 | A1 | 9/2017 | Brennan et al. | |
| 2017/0287399 | A1 | 10/2017 | Ahmed et al. | |
| 2017/0294479 | A1 | 10/2017 | Cha et al. | |
| 2017/0301838 | A1 | 10/2017 | Camras et al. | |
| 2018/0014372 | A1 | 1/2018 | Chen et al. | |
| 2018/0047782 | A1 | 2/2018 | Percival | |
| 2018/0090058 | A1 | 3/2018 | Chen et al. | |
| 2018/0114800 | A1 | 4/2018 | Pan | |
| 2018/0181244 | A1 * | 6/2018 | Sato | G09G 3/3677 |
| 2018/0219005 | A1 | 8/2018 | Bedell et al. | |
| 2018/0269191 | A1 | 9/2018 | England et al. | |
| 2018/0277524 | A1 | 9/2018 | Moon et al. | |
| 2018/0331085 | A1 | 11/2018 | Chang et al. | |
| 2019/0326348 | A1 | 10/2019 | Im et al. | |
| 2021/0118353 | A1 * | 4/2021 | Sakariya | G09G 3/2081 |

FOREIGN PATENT DOCUMENTS

| | | | |
|---|---|---|---|
| KR | 1020140077120 | | 6/2014 |
| KR | 20170098882 | A | 8/2017 |
| WO | WO2014193102 | | 12/2014 |
| WO | 2017149521 | A1 | 9/2017 |

OTHER PUBLICATIONS

International Search Report and Written Opinion for PCT/US2019/066888, dated Apr. 14, 2020, 10 pages.

International Search Report and Written Opinion for PCT/US2029/066940, dated Apr. 29, 2020, 17 pages.

"Micro-LED Arrays: Tomorrow's smart lighting and display technology", Brochure; Leti, technology research institute; Apr. 2017.

Cok, Ronald S., "Inorganic light-emitting diode displays using micro-transfer printing", Journal of the Society for Information Display 25(10), pp. 589-609; 2017.

Fan, Ching-Lin , et al., "Display Technology Letters: Novel LTPS-TFT Pixel Circuit with OLED Luminance Compensation for 3D AMOLED Displays", Journal of Display Technology, vol. 12, No. 5, pp. 425-428; May 2016.

Herrnsdorf, Johannes , et al., "Active-Matrix GaN Micro Light-Emitting Diode Display With Unprecedented Brightness", IEEE Transactions on Electron Devices, vol. 62, No. 6, pp. 1918-1925; Jun. 2015.

Kang, Chang-Mo, et al., "Fabrication of a vertically-stacked passive-matrix micro-LED array structure for a dual color display", Optics Express, vol. 25, No. 3; Feb. 6, 2017: pp. 2489-2495.

Kim, Hyo-Min, et al., "High Brightness Active Matrix Micro-LEDs with LTPPS TFT Backplane", Society for Information Display 2018 Digest, pp. 880-883; 2018.

Lee, V.W., et al., "A directly addressed monolithic LED array as a projection source", Journal of the Society for Information Display, 18(10), pp. 808-812; 2010.

Liu, Zhaoju, et al., "Decoding Micro-LED's Current Driving Methods", LEDinside of TrendForce Corp; Oct. 18, 2016.

Meitl, Matthew, et al., "Passive Matrix Displays with Transfer-Printed Microscale Inorganic LEDs", Society for Information Display 2016 Digest, pp. 743-746; 2016.

Peng, Deng, et al., "Full-Color Pixelated-Addressable Light Emitting Diode on Transparent Substrate (LEDoTS) Micro-Displays by CoB", IEEE, Journal of Display Technology, pp. 742-746; 2016.

Ploch, Neysha Lobo, "Chip designs for high efficiency III-nitride based ultraviolet light emitting diodes with enhanced light extraction", Doctoral Thesis; Technische Universität Berlin, Fakultät II—Mathematik und Naturwissenschaften; 2015.

Radauscher, Erich J., et al., "Miniaturized LEDs for Flat-Panel Displays", Proc. SPIE 10124, Light-Emitting Diodes: Materials, Devices, and Applications for Solid State Lighting XXI, 1012418; Feb. 16, 2017.

Sakakibara, Naoki, et al., "Independent drive of integrated multicolor (RGBY) micro-LED array using regularly arrayed InGaN based nanocolumns", 22nd Microoptics Conference (MOC2017), Tokyo, Japan, Nov. 19-22, 2017; The Japan Society of Applied Physics.

Shih, Yu-Chou, et al., "Chapter 17: LED Die Bonding", Materials for Advanced Packaging, Springer International Publishing; Switzerland 2017.

Smith, Euan C., "Total matrix addressing", Journal of the Society for Information Display 16(2), pp. 201-209; 2008.

Stauth, Sean A., et al., "Self-assembled single-crystal silicon circuits on plastic", Proceedings of the National Academy of Sciences, vol. 103, No. 38, pp. 13922-13927; Sep. 19, 2006.

Sun, Liusheng, et al., "A Micro-LED Driver with Bandwidth Expansion for Visible Light Communications", ECE Department, the Hong Kong University of Science and Technology, Hong Kong, 2017.

Yeo, Kiat Seng, et al., "Micro-LED arrays for display and communication: device structure and driver architecture", Singapore University of Technology and Design, Singapore; IEEE, 2017.

Zhang, Ke, et al., "Fully integrated active matrix programmable UV and blue micro-led display system on panel (SOP)", Journal of the Society for Information Display, 25(4), pp. 240-248; 2017.

* cited by examiner

ADDRESSING FOR EMISSIVE DISPLAYS

BACKGROUND

Technical Field

The present disclosure generally relates to addressing for emissive displays and, in particular, an addressing system a light emitting semiconductor display having an architecture which improves the interconnect density of circuits by using on-panel image shifting techniques.

Description of the Related Art

Current addressing systems for LED technology typically presuppose the requirement to show arbitrary or nearly arbitrary natural images on the display. This requires a high level of addressability for the pixels in a display system and, consequently, circuitry and interconnects configured to generate an arbitrary pattern.

In one family of conventional techniques, referred to as total matrix addressing (TMA), passive matrix addressing is used together with a decomposition of the image into a set of mathematically determined bases that allow for the drive of multiple selection lines per driven column while forming pixel elements. This decomposition allows for a decrease in the drive voltage and the potential for a higher duty cycle in LED emission, which can improve the lifetime for a given luminance. Because the inverse function used in TMA is not necessarily conservative, the images formed by TMA are not necessarily exact replicas of the drive image. The decomposition leads to some low pass filtering, which softens line edges and can lead to smearing or blurring of the images intended for generation. The lack of an exact representation of the source data can be problematic. Furthermore, the TMA approach is not directly applicable to active matrix systems, which do not offer the same drive structure as passive matrix devices.

In the conventional approach described in Smith (Journal of the Society for Information Display, Feb. 16, 2008), a system is proposed which uses multiple lines addressed in an active matrix configuration and which uses the same basis sets as in image compression. This approach allows for compressed images to be sent directly to the display, and the decomposition of the compressed image using the basis set forms a decompressed version of the image on the screen. In a similar active addressing approach proposed for liquid crystal displays, Sadi et al. (U.S. Pat. No. 5,475,397) allows image decompression on the fly while in operation (see also, Orlen et al., U.S. Pat. No. 5,654,734). In the case of LCD, the drive voltage can be reduced, reducing the energy loss associated with capacitive charging and discharging. As with total matrix addressing, the decomposition and inverse function when applied to emissive displays does not reconstruct arbitrary images perfectly. The approach leads to some low pass filtering, which softens line edges and can lead to smearing or blurring of the images intended for generation.

In Jepsen et al. (U.S. Pat. No. 9,557,954), a system is described in which addressing is simplified in a large display by the creation of sub-panels in the larger display, which due to their smaller size have a reduced overhead for the creation of interconnect and reduced demand for the interconnect typically required for addressing. However, this approach does not change the on-panel drive waveforms required for operation or the overall data bandwidth that needs to be supplied to the aggregate display system.

BRIEF SUMMARY

A method of for addressing an emissive display having a plurality of pixels arranged into rows and columns may be summarized as including receiving a first clock signal at an address select input of a first row of the display; receiving data signals at data signal inputs of the first row of the display, each of the received data signals corresponding to a column of the display; outputting, when the first clock signal is active at the address select input, the data signals to corresponding drivers of light emitting semiconductors of the first row and via corresponding data signal outputs of the first row; receiving the data signals from the data signal outputs of the first row at a first row of shift registers; receiving a second clock signal at the first row of shift registers; outputting, when the second clock signal is active, the data signals from the first row of shift registers; and receiving the data signals output at corresponding drivers of light emitting semiconductors of a second row of the display.

The method may further include receiving the data signals at one or more non-display buffer rows, each comprising a plurality of shift registers. The method may further include receiving the data signals output from the first row of shift registers at a second row of shift registers; receiving a third clock signal at the second row of shift registers; and outputting, when the third clock signal is active, the data signals from the second row of shift registers. The method may further include applying a mathematical function to the data signals prior to the receiving of the data signals at the second row of shift registers. The method may further include outputting, to external circuitry, the data signals prior to the receiving of the data signals at the second row of shift registers.

The method may further include activating a first clock signal communicatively coupled to the address select input; sending the data signals to the data signal inputs while the first clock signal is active; deactivating the first clock signal; activating a first enable signal communicatively coupled to the first row of shift registers to store data from the data signals in the first row of shift registers; and deactivating the first enable signal.

The method may further include activating the second clock signal communicatively coupled to the first row of shift registers to output the data signals from the first row of shift registers; deactivating the second clock signal; activating a second enable signal communicatively coupled to the second row of shift registers to store the data from the data signals in the second row of shift registers; and deactivating the second enable signal.

A system for addressing an emissive display having a plurality of pixels arranged into rows and columns may be summarized as including a first row of pixels including a plurality of drivers, each driver having a corresponding light emitting semiconductor, the first row being communicatively coupled to receive a first clock signal at an address select input and to receive data signals at data signal inputs, each of the received data signals corresponding to a column of the display, the first row being further communicatively coupled to output, when the first clock signal is active at the address select input, the data signals to corresponding ones of the plurality of drivers and to output the data signals via corresponding data signal outputs of the first row; a first row of shift registers communicatively coupled to receive the data signals from the data signal outputs of the first row and to receive a second clock signal, the first row of shift registers being further communicatively coupled to output the data signals when the second clock is active; and a second row of pixels including a plurality of drivers, each driver having a corresponding light emitting semiconductor, the second row being communicatively coupled to receive the data signals output from the first row of shift registers at corresponding ones of the plurality of drivers of light emitting semiconductors of the second row of the display.

The system may further include one or more non-display buffer rows communicatively coupled to receive the data signals, each of the non-display buffer rows comprising a plurality of shift registers. The system may further include a second row of shift registers communicatively coupled to receive the data signals output from the first row of shift registers; to receive a third clock signal; and to output, when the third clock signal is active, the data signals from the second row of shift registers.

An addressing system for an emissive display having a plurality of pixels arranged into rows and columns may be summarized as including a first thin film transistor (TFT) communicatively coupled to receive a first clock signal at an address select input at a gate of the first TFT and a data signal input at a drain of the first TFT, wherein when the first clock signal is active at the gate of the first TFT, the data signal is passed from the drain of the first TFT to the source of the first TFT; a second TFT communicatively coupled to receive the data signal from the source of the first TFT at a gate of the second TFT, the second TFT driving a first light emitting semiconductor, in a first row of the display, connected to a drain of the second TFT; a first shift register comprising at least a third TFT, the first shift register being communicatively coupled to receive the data signal from the source of the first TFT, the first shift register receiving a second clock signal, wherein when the second clock signal is active, the data signal is output by the first shift register; and a fourth TFT communicatively coupled to receive the data signal output by the first shift register at a gate of the fourth TFT, the fourth TFT driving a second light emitting semiconductor, in a second row of the display, connected to a drain of the fourth TFT.

The system may further include a second shift register comprising at least a fifth TFT, the second shift register being communicatively coupled to receive the data signal from the first shift register, the second shift register receiving a third clock signal, wherein when the third clock signal is active, the data signal is output by the second shift register; and a sixth TFT communicatively coupled to receive the data signal output by the second shift register at a gate of the sixth TFT, the sixth TFT driving a third light emitting semiconductor, in a third row of the display, connected to a drain of the sixth TFT.

The first shift register may include a latch in which the third TFT is communicatively coupled to receive the data signal from the source of the first TFT at a drain of the third TFT; the third TFT is communicatively coupled to receive the second clock signal at a gate of the third TFT; and when the second clock signal is active, the data signal received at the drain of the third TFT is output at the source of the third TFT and output by the first shift register.

The first shift register may include a first stage in which the received data signal is input to a source of the third TFT; the data signal is output at a drain of the third TFT to a gate of a seventh TFT when a first enable signal is active at the gate of the third TFT; the gate of the third TFT is connected to a gate of an eighth TFT; and a drain of the seventh TFT and a source of the eighth TFT are connected and output the data signal from the first stage of the first shift register. The first shift register may further include a second stage, in which the data signal received from the first stage of the first shift register is input to a source of a ninth TFT; the data signal is output at a drain of the ninth TFT when the second clock signal is active at a gate of the ninth TFT; the data signal output by the ninth TFT is input to the gate of a tenth TFT; and a drain of the tenth TFT and a source of an eleventh TFT are connected and output the data signal from the first shift register.

The system may further include at least one processor; and at least one non-transitory processor-readable storage medium communicatively coupled to the at least one processor and which stores at least one of processor-executable instructions or data that, when executed by the at least one processor, cause the at least one processor to: activate a first clock signal communicatively coupled to the address select input; send the data signal to the data signal input while the first clock signal is active; deactivate the first clock signal; activate a first enable signal communicatively coupled to the first shift register to store the data signal in the first shift register; and deactivate the first enable signal.

The at least one non-transitory processor-readable storage medium may further store at least one of processor-executable instructions or data that, when executed by the at least one processor, cause the at least one processor to: activate the second clock signal communicatively coupled to the first shift register to output the data signal from the first shift register; deactivate the second clock signal; activate a second enable signal communicatively coupled to the second shift register to store the data signal in the second shift register; and deactivate the second enable signal.

A method for addressing an emissive display having a plurality of pixels arranged into rows and columns may be summarized as including receiving a first clock signal at an address select input at a gate of a first thin film transistor (TFT) and a data signal input at a drain of the first TFT, wherein when the first clock signal is active at the gate of the first TFT, the data signal is passed from the drain of the first TFT to the source of the first TFT; receiving the data signal from the source of the first TFT at a gate of a second TFT, the second TFT driving a first light emitting semiconductor, in a first row of the display, connected to a drain of the second TFT; receiving the data signal from the source of the first TFT at a first shift register comprising at least a third TFT, the first shift register receiving a second clock signal, wherein when the second clock signal is active, the data signal is output by the first shift register; and receiving the data signal output by the first shift register at a gate of a fourth TFT, the fourth TFT driving a second light emitting semiconductor, in a second row of the display, connected to a drain of the fourth TFT.

The method may further include receiving the data signal from the first shift register at a second shift register comprising at least a fifth TFT, the second shift register receiving a third clock signal, wherein when the third clock signal is active, the data signal is output by the second shift register; and receiving the data signal output by the second shift register at a gate of a sixth TFT, the sixth TFT driving a third light emitting semiconductor, in a third row of the display, connected to a drain of the sixth TFT.

The method may further include activating a first clock signal communicatively coupled to the address select input; sending the data signal to the data signal input while the first clock signal is active; deactivating the first clock signal; activating a first enable signal communicatively coupled to the first shift register to store data from the data signal in the first shift register; and deactivating the first enable signal.

The method may further include activating the second clock signal communicatively coupled to the first shift register to output the data signal from the first shift register; deactivating the second clock signal; activating a second enable signal communicatively coupled to the second shift register to store the data from the data signal in the second shift register; and deactivating the second enable signal.

The method may further include inputting the received data signal to a source of the third TFT, in a first stage of the first shift register; and outputting the data signal at a drain of the third TFT to a gate of a seventh TFT when the first enable signal is active at the gate of the third TFT, the gate of the third TFT being connected to a gate of an eighth TFT, wherein a drain of the seventh TFT and a source of the eighth TFT are connected and output the data signal from the first stage of the first shift register.

The method may further include inputting the data signal received from the first stage of the first shift register to a source of a ninth TFT, in a second stage of the first shift register; and outputting the data signal at a drain of the ninth TFT when the second clock signal is active at a gate of the ninth TFT, the data signal output by the ninth TFT being input to the gate of a tenth TFT, wherein a drain of the tenth TFT and a source of an eleventh TFT are connected and output the data signal from the first shift register.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Figure 1:
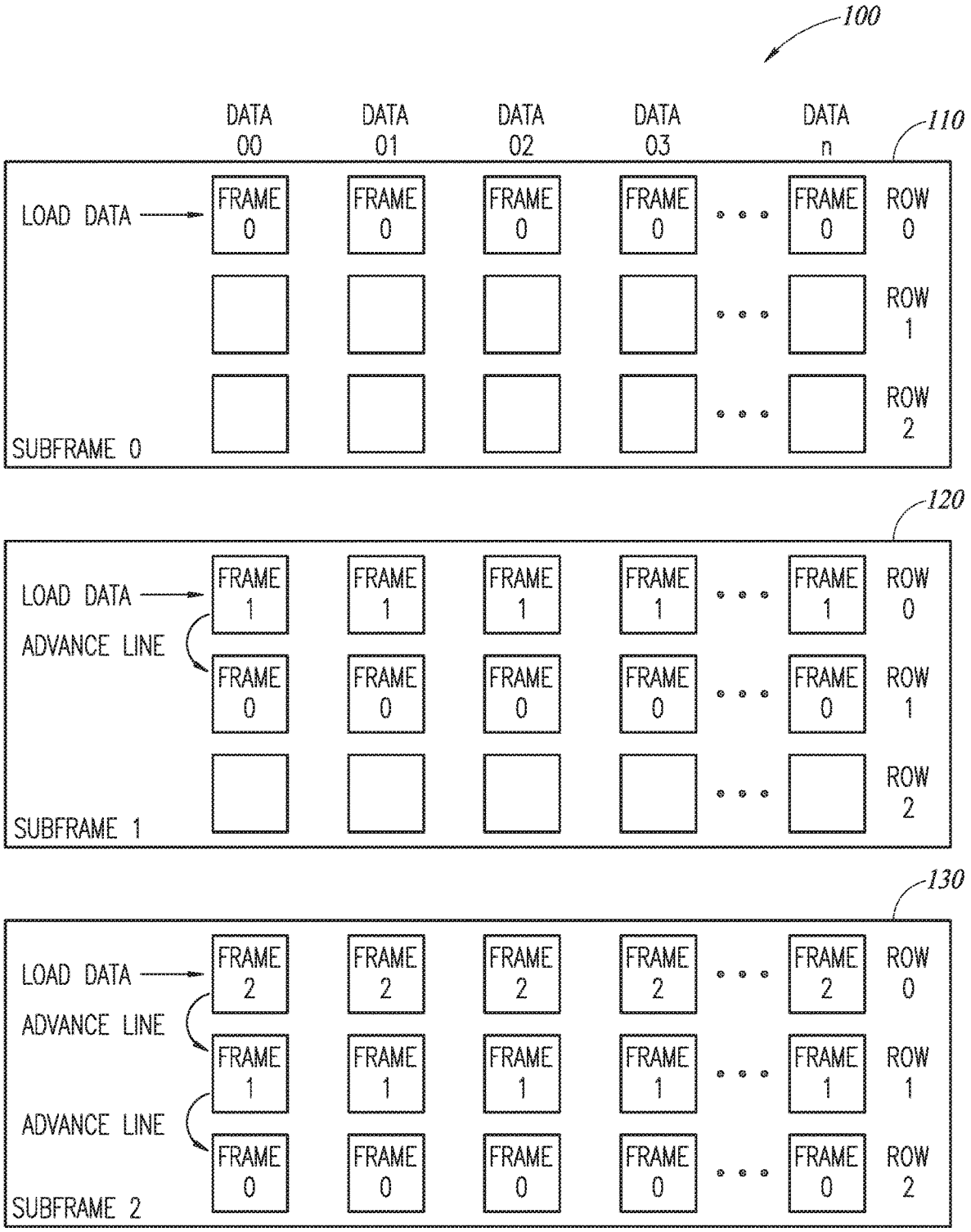
FIG. 1 is a flow diagram showing signal transfer in a display addressing system of a light emitting semiconductor display panel.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, certain structures associated with light emitting diodes (LEDs), drive circuits, integrated circuits and fabrication equipment have not been shown or described in detail to avoid unnecessarily obscuring descriptions of the implementations.

Unless the context requires otherwise, throughout the specification and claims that follow, the word "comprise" and variations thereof, such as, "comprises" and "comprising" are to be construed in an open, inclusive sense, that is as "including, but not limited to."

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations Reference throughout this specification to "one implementation" or "an implementation" or "one embodiment" or "an embodiment" means that a particular feature, structure or characteristic described in connection with the embodiment is included in at least one implementation or at least one embodiment. Thus, the appearances of the phrases "one implementation" or "an implementation" or "in one embodiment" or "in an embodiment" in various places throughout this specification are not necessarily all referring to the same implementation or the same embodiment. Furthermore, the particular features, structures, or characteristics may be combined in any suitable manner in one or more implementations or in one or more embodiments As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations or embodiments.

Described herein is addressing system for an emissive display, such as a light emitting semiconductor display, which allows for the simplification of the electronics used in an image generation element in which the display is projecting images which can, at least partially, be derived from previous images presented on the display. The use of on-panel image shifting and derivative image formation reduces the need for the interconnect associated with arbitrary image formation and can both simplify the addressing and accelerate the movement of data into and out of displays used for non-arbitrary image generation. In displays in which repeating or fixed patterns are projected, for example, such addressing can be used to track the movement of a sample or a sample stage, and the display electronics can use an integral shift-register or image copier approach to reduce the bandwidth of interconnect and the circuit area devoted to arbitrary image construction. The architecture of the embodiments described herein will allow for the creation of higher performance and lower energy image generation systems for non-arbitrary image formation.

Described herein is display addressing circuitry for non-arbitrary image patterns in which the display image can be formed using information from previous images displayed. By use of on-panel memory and shift elements on the display panel at the pixel and row level, a significant simplification in interconnect and increase in bandwidth can be achieved. This disclosed embodiments are applicable to a number of display applications that integrate high intensity light generation elements for non-arbitrary patterns of use in a range of applications.

Described herein are implementations of an emissive display in which a fraction of the pixels are arbitrarily addressed, and the image from this fraction of the pixels is used to derive a signal for the remaining pixels. In implementations, the derived image is formed by translating the signal from the fraction of the pixels to neighboring pixel areas. In implementations, the translation can occur in more than one direction using multiple clock signals. A strobe signal may be used to activate the display for a fraction of the frame time. A reset signal may set the pixels in a region to a pre-determined state. The architecture described herein may be used in conjunction with various types of emissive displays, such as, for example, OLED, LED, micro-LED, plasma, and field emission displays.

In disclosed embodiments, the interconnect and drive used in a display are simplified by copying some of the data internally using a data shift/copy control. This copied data could be a clone, i.e., a modified composite image based on information previously written to the display. Additionally, the output of the display may be strobed by an additional local or global enable function, thereby limiting the time period in which the light output is active for the display.

The signal written to and translated in the display can be an analog or digital signal, depending on the drive architecture. Variations in emitted light intensity can also be achieved by driving the LED for a shorter period of time (e.g. by adjusting the duration of the enabling strobe). Operation in such a pulse width modulation (PWM) mode can improve efficiency by operating the LED at the current driving point of maximum efficiency.

FIG. 1 is a flow diagram showing signal transfer in a display addressing system 100 of a light emitting semiconductor display panel from one row to the rest of the rows of the display panel. The display panel of the disclosed embodiments allows for data loading in a limited number of rows (e.g., the first row). Upon clocking, the image data is copied from the data loading rows to other areas in the display.

This architecture allows for a reduced number of lines loading data and bringing addressing in from the sending signals into the display panel matrix. In implementations, the shift architecture can be structured, for example, in a 2-row architecture, which would halve the number of globally addressable lines. More generally, an n-row architecture can be implemented, thereby reducing the number of globally addressable lines by n. In embodiments, one line can be used to read in the signals for the whole display.

In the implementation depicted in FIG. 1, three rows of data are loaded into the display array using a single select line, i.e., a select line directed to the first row (row 0) of the display array. In a first subframe 110, data (data 00, data 01, data 02, data 03 . . . data n) for the first frame (frame 0) is loaded onto a first line (row 0) of the display array. In a second subframe 120, after a line advance signal (e.g., one or more clock signals) is received, the data from the first line (row 0) is copied to a second line (row 1) of the display. This is followed by data (data 00, data 01, data 02, data 03 . . . data n) for the second frame (frame 1) being loaded onto the first line (row 0) of the display array. This results in the second subframe 120 having the data for the first frame (frame 0) in the second row (row 1) of the subframe and the data for the second frame (frame 1) in the first row (row 0) of the subframe.

In a third subframe 130, after a line advance (e.g., one or more clock signals) is received, the data from the second line (row 1) is copied to a third line (row 2), and the data from the first line (row 0) is copied to the second line (row 1), This is followed by data (data 00, data 01, data 02, data 03 . . . data n) for the third frame (frame 2) being loaded onto the first line (row 0) of the display array. This results in the third subframe 130 having the data for the first frame (frame 0) in the third row (row 2) of the subframe, the data for the second frame (frame 1) in the second row (row 1) of the subframe, and the data for the third frame (frame 2) in the first row (row 0) of the subframe.

The architecture of the disclosed embodiments allows for reduced bonding area, because with fewer addressing lines and more shared clock lines, the display can have a significantly fewer number of externally-connected signal and data lines. This, in turn, reduces the fraction of the panel which is devoted to passing signals into the system. Furthermore, with fewer long data lines, a reduction in interconnect cross-overs, and a reduction in the capacitive transistor drive on each data line, there can be a significant reduction in the parasitic capacitance and series resistance associated with each data line. A reduction in these parasitic properties increases the speed of addressing and reduces the power consumption associated with the charge/discharge of each signal line during each subframe. In addition, the signal transfer between rows occurs over short lines with limited exposure to parasitic elements. This allows for the row-copy operation to occur at a significantly higher speed than would be possible in a global addressing architecture.

Rolling addressing of the display, as described above, allows for the duplication of the signal in many applications, particularly inspection or exposure applications in which the samples are translated. This allows for each target pixel area to be addressed by a significant number of pixels in the display engine unit. Therefore, dead pixels and non-uniform intensity and efficiency are averaged out by the exposure of these areas to multiple lines of the display. The architecture of the disclosed embodiments thus provides improvement of uniformity and resistance to dead/high/low pixels.

The architecture of the disclosed embodiments allows for a more flexible implementation of a global or local strobe activation, thereby providing greater control over exposure time. For example, the architecture allows implementation of a global flash function that is uniform across the display. The architecture also allows for blanking of the display during the update time, thereby eliminating the rolling update that might otherwise be seen during data update or addressing. The use of a short strobe may also be useful in non-display light emitters, such as for gated measurement of fluorescence in which the target is illuminated with the display element.

In addition to the shift clock signal and local or global strobe activation signal discussed above, implementations of a display can incorporate a global or regional "reset" signal which sets the setting on each pixel to a uniform, predetermined value (e.g., off, full intensity, etc.). Such a signal can be used to place the display into a predictable state at the beginning of its operation, to implement additional functions (e.g., use of the display unit as a flood lamp), and to allow for a variable number of copied lines in the disclosed image shift architecture by, for example, zeroing the image after a variable number of line copies have been performed.

In implementations, a translated (i.e., copied) signal may be different from the previously written signal. It may be favorable, for example, to implement a digital or analog function based on the previous signal pattern to the signal of the next frame. Such a pattern can be used, for example, to avoid over-exposing an area of the substrate or to form predictable patterns without the need for explicitly addressing the elements in each frame.

In implementations, a non-display row or rows may be inserted as part of the data matrix. A first row, for example, can be inserted which has shift registers but does not include display drive elements. Such a row can be used to set up the data flow, without display elements showing a pattern during data loading. Such buffer rows can also be inserted internally to the matrix to provide a shift or clock delay or to translate the signal on clock actuation. Embodiments may include an array of outputs from the display to transmit the processed signal from some point in the matrix to external circuitry. For example, in cases in which the signal is processed on the panel, such a signal can contain useful information for analysis or transmission to other display elements connected in series.

Figure 2:
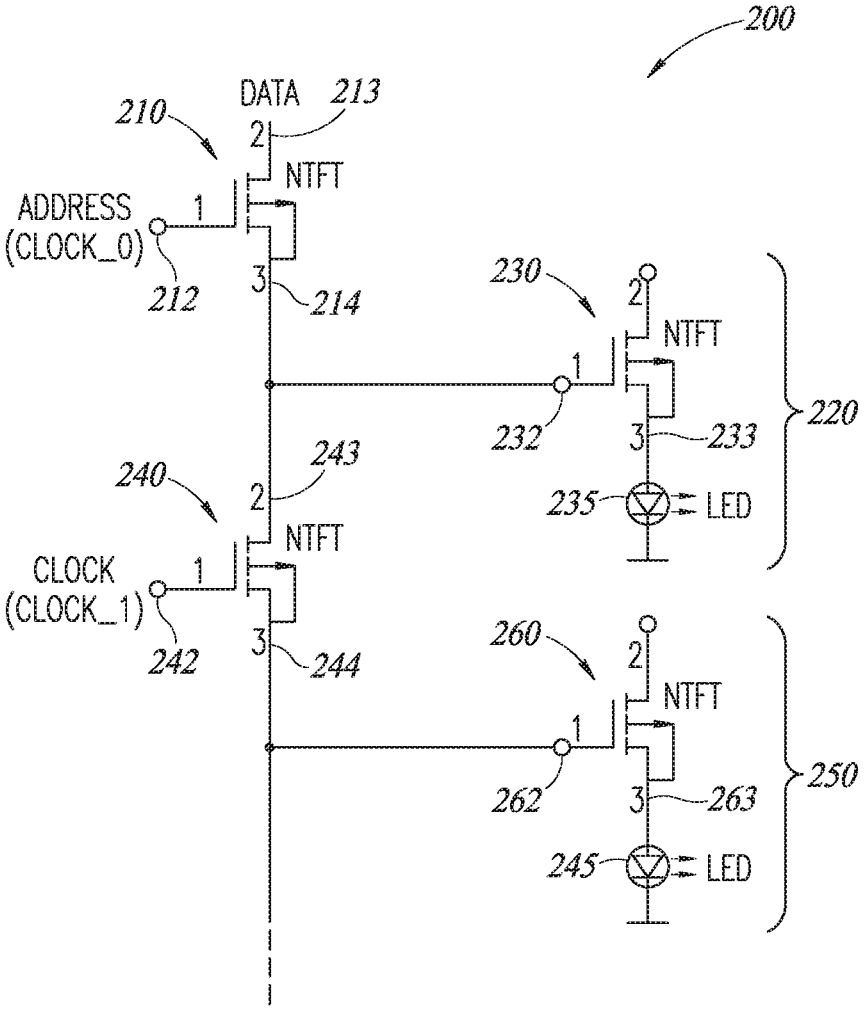
FIG. 2 is a diagram of a thin film transistor (TFT) circuit for latching and shift copying signals from a row to a subsequent row, according to one illustrated implementation.

FIG. 2 is a diagram of a thin film transistor (TFT) circuit 200 for latching and shift copying signals from a row of the display to a subsequent row. In the example depicted, the TFTs are n-type (NTFT), but p-type TFTs could be used, as well as other types of semiconductor devices. The storage and duplication of the signal is achieved using controlled clock signals, which carry data from the first row to subsequent rows. Depending on the number of rows that are being copied, the number of data line connections can be substantially reduced. As discussed in further detail below, the data signal is passed from the source of a TFT of one row to the drain of a TFT of the subsequent row. A clock signal serves as the address signal for the subsequent row. This operation is repeated multiple times. Therefore, no address line connection is needed for the rows into which data is copied. The number of rows receiving copied data may be determined by factors such as the bias voltage of the data signal and the TFT holding time.

In the depicted embodiment, a first TFT 210, in a first row 220 of the display, receives an address select signal at its gate 212 and receives a data signal at its drain 213. In embodiments, the address select signal may be a clock signal (e.g., Clock_0) (see FIG. 4). When the address signal is active, i.e., when it goes high (or low, in some implementations), the data is passed from the drain 213 to the source 214 of the first TFT 210. The output from the source 214 of the first TFT 210 is connected to the gate 232 of a second TFT 230 which drives an LED 235 connected to its drain 233.

The output from the source 214 of the first TFT 210 is also connected to the drain 243 of a third TFT 240 in a second row 250 of the display. The third TFT 240 receives a clock signal at its gate 242 and serves a latch which controls the flow of data to subsequent rows of the display. In embodiments, the clock signal may be one of a set of multiple clock signals (e.g., Clock_1) (see FIG. 4). In embodiments, the latch may include more than a single TFT, i.e., the latch may be a circuit formed of TFTs and other components. For example, in implementations depicted in FIGS. 3 and 4, the latch takes the form of a two-stage shift register. The latch may be referred to as a "shift register," even in implementations in which the latch is formed of a single TFT. When the clock signal is active, the data received from the first row 220 at the drain 243 of the third TFT 240 is output by the source 244 of the third TFT 240. The output from the source 244 of the third TFT 240 is connected to the gate 262 of a fourth TFT 260 which drives an LED 245 connected to its drain 263. The output from the source 244 of the third TFT 240 is also connected to the drain of an TFT of a subsequent row (not shown) in implementations in which there is a third row.

Figure 3:
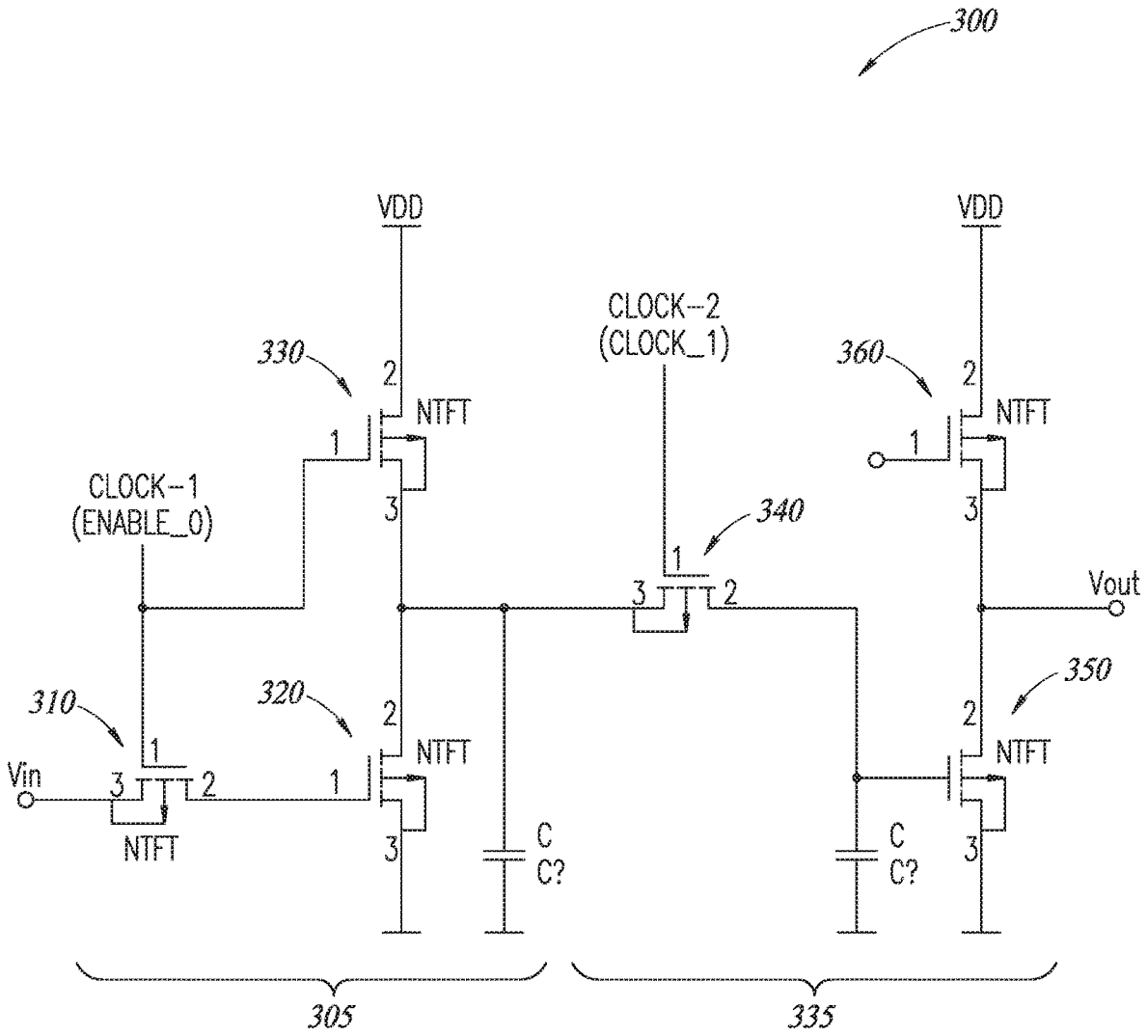
FIG. 3 is a diagram of a TFT shift register circuit, according to one illustrated implementation.

FIG. 3 is a diagram of an TFT shift register circuit 300, which is used to transfer data signals to a subsequent row in a manner similar to the latch discussed above. In embodiments, an input voltage $V_{in}$ is connected to a pixel data line (i.e., a pixel in a particular row) which is to be transferred/copied. An output voltage, $V_{out}$, is connected to the data line of the next pixel, i.e., a pixel in the subsequent row. In implementations, the clock signals used are simpler than those of a shift register-less scheme. Also, in such an arrangement, the pixel data signal retention is robust because the output of the shift register is digital.

The input voltage, $V_{in}$, is received from a row of the display. The output voltage, $V_{out}$, is output to a subsequent row of the display based on the operation of first and second clock signals, clock-1 and clock-2. The first stage 305 of the shift register circuit 300 inputs the received signal to the source of a first TFT 310. The signal is output at the drain of the first TFT 310 to the gate of a second TFT 320, in accordance with the first clock signal (clock-1) input to the gate of the first TFT 310. The first clock signal, thus, controls the receipt of the data signal into the shift register circuit 300 and may be referred to as an enable signal (e.g., Enable_0) (see FIG. 4). The gate of the first TFT 310, and hence the first clock signal (clock-1), are connected to the gate of a third TFT 330, The drain of the second TFT 320 and the source of the third TFT 330 are connected and output the signal to the second stage 335 of the shift register circuit 300. This arrangement, in effect, stores the data obtained from the data signal in digital form in the first stage 305 of the shift register circuit 300.

In the second stage 335, the signal is input to the source of a fourth TFT 340 and is output by the drain of the fourth TFT 340 under the control of a second clock signal (clock-2) connected to the gate of the fourth TFT 340. The signal output by the fourth TFT 340 is input to the gate of a fifth TFT 350. The drain of the fifth TFT 350 is connected to the source of a sixth TFT 360 (the gate of which is connected to its drain) and this junction outputs the signal from the shift register as an output voltage, $V_{out}$.

Figure 4:
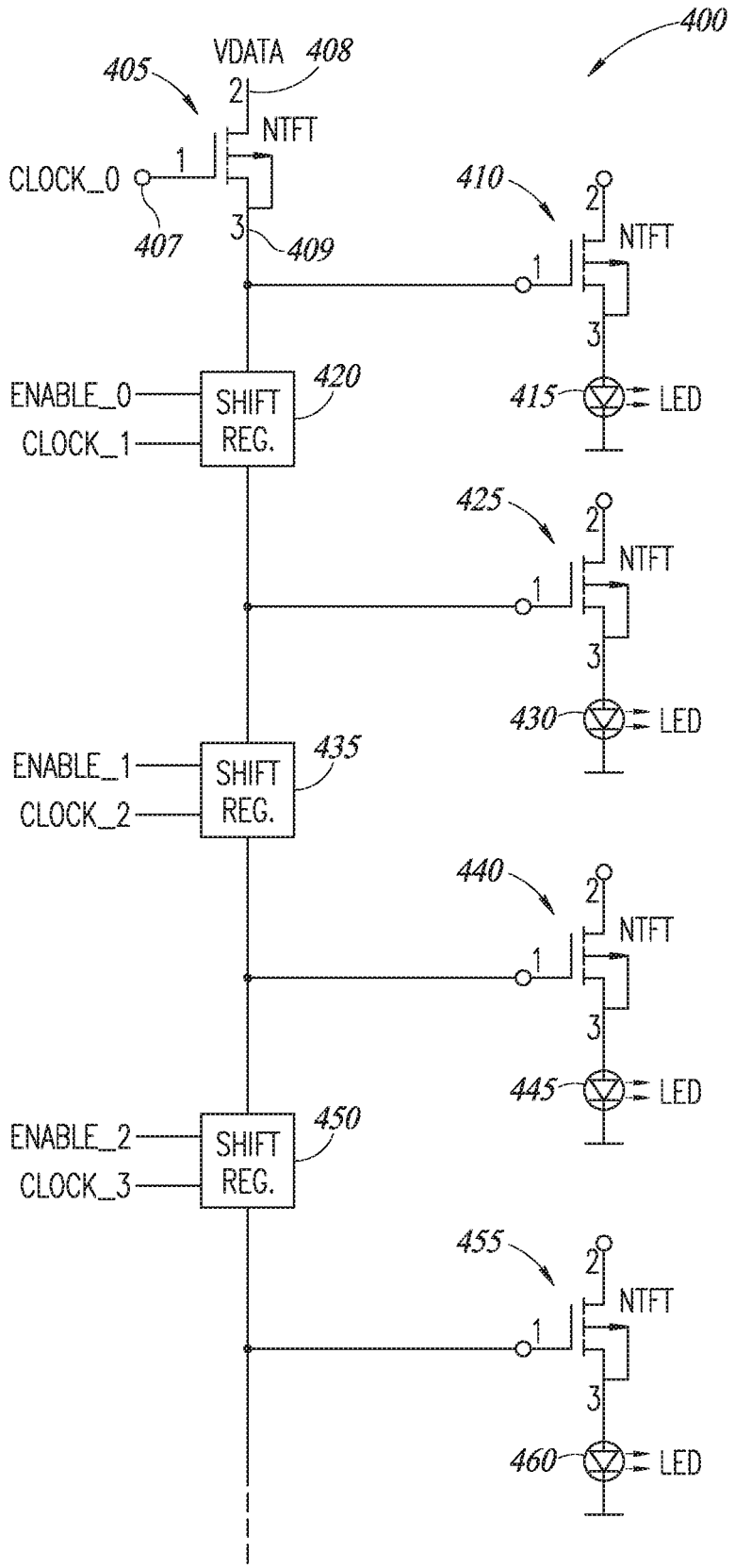
FIG. 4 is a diagram of a row-shift pixel circuit using TFT shift registers, as shown in FIG. 3, according to one illustrated implementation.

FIG. 4 is a diagram of a row-shift pixel circuit 400 using TFT shift registers, e.g., as shown in FIG. 3. The depicted implementation is a 4-row shifting arrangement. However, any number of rows may be implemented, depending on practical considerations. As in embodiments discussed above, there are data signals and an address signal (i.e., select signal) for every row. In this implementation, as discussed in further detail below, the select lines of the relayed (i.e., shifted) rows are connected to separated clock signals. This arrangement allows the clock rate to be controlled to match the required frame refresh rate while adding image loading flexibility and reducing the number of connections.

In the example shown in FIG. 4, a first TFT 405, in a first row of the display, receives an address select signal at its gate 407 in the form of a clock signal (Clock_0) and receives a data signal (VData) at its drain 408. When the address signal is active at the gate 407, the data is passed from the drain 408 to the source 409 of the first TFT 405. The output from the source 409 of the first TFT 405 is connected to the gate of a second TFT 410 which drives an LED 415 connected to its drain. The output from the source 409 of the first TFT 405 is also connected to the input of a first shift register 420. The first shift register 420 passes pixel data from the first row of the display to a subsequent row under the control of clock signals which, in the depicted implementation, are in the form of an enable signal (e.g., Enable_0) and a clock signal (e.g., Clock_1).

The output of the first shift register 420 is connected to the gate of a third TFT 425 in a second row of the display. The third TFT 425 drives an LED 430 connected to its drain. The output of the first shift register 420 is also connected to the input of the second shift register 435. The second shift register 435 passes pixel data from the second row of the display to a subsequent row under the control of an enable signal (e.g., Enable_1) and a clock signal (e.g., Clock_2).

The output of the second shift register 435 is connected to the gate of a fourth TFT 440 in a third row of the display. The fourth TFT 440 drives an LED 445 connected to its drain. The output of the second shift register 435 is also connected to the input of a third shift register 450. The third shift register 450 passes pixel data from the third row of the display to a subsequent row under the control of an enable signal (e.g., Enable_2) and a clock signal (e.g., Clock_3).

The output of the third shift register 450 is connected to the gate of a fifth TFT 455 in a fourth row of the display. The fifth TFT 455 drives an LED 460 connected to its drain. The output of the third shift register 450 is also connected to the gate of an TFT in a subsequent row of the display (not shown) and to an additional shift register (not shown) in implementations having more than four rows. The arrangement may be repeated, as necessary, to drive additional rows of the display.

Figure 5:
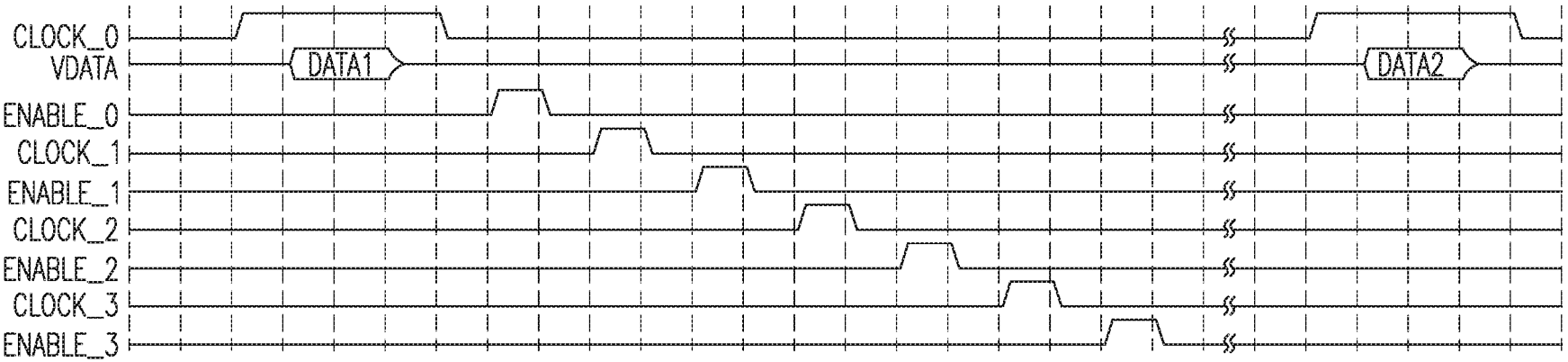
FIG. 5 is a diagram showing the signal enable and clock for advancing data from a row to a subsequent row, according to one illustrated implementation.

FIG. 5 is a diagram showing the timing of signal enable and clock signals for advancing data from a row to a subsequent row. In implementations, clocks for enabling the light output as well as shifting the data from one row to the next can be independently included.

When a first clock signal (Clock_0) goes high, display data (VData) is received and loaded into the first row (row 0) of a display array. The first clock signal (Clock_0) may correspond to an address select signal, as discussed above in the embodiments depicted in FIGS. 2 and 4. The first clock signal (Clock_0) remains high as the data (Data1) for the first row is received and then goes low. The received data (Data1) is output both to the LED of the first row (e.g., FIG. 4, 415) and to the input of the first shift register (e.g., 420), which is between the first row and the second row. A first enable signal (Enable_0) goes high to receive and store the data in the first stage of the first shift register (e.g., 420). Thus, following the first clock signal (Clock_0) and the first enable signal (Enable_0), the data (Data1) is stored in the first shift register (e.g., 420).

The second clock signal (Clock_1) goes high to pass the data from the first stage of the first shift register to the second stage and output of the first shift register (e.g., 420). This results in the data being output both to the LED of the second row (e.g., 430) and to the first stage of the second shift register (e.g., 435), which is between the second row and the third row. A second enable signal (Enable_1) goes high to receive the data in the first stage of the second shift register (e.g., 435). Thus, following the second clock signal (Clock_1) and the second enable signal (Enable_1), the data (Data1) is stored in the second shift register (e.g., 435).

The third clock signal (clock_2) goes high to pass the data from the first stage of the second shift register to the second stage and output of the second shift register (e.g., 435). This results in the data being output both to the LED of the third row (e.g., 445) and to the first stage of the third shift register (e.g., 450), which is between the third row and the fourth row. A third enable signal (enable_2) goes high to receive the data in the first stage of the third shift register (e.g., 450). Thus, following the third clock signal (clock_2) and the third enable signal (enable_2), the data (Data1) is stored in the third shift register (e.g., 450).

The fourth clock signal (clock_3) goes high to pass the data from the first stage of the third shift register to the second stage and output of the third shift register (e.g., 450). This results in the data being output both to the LED of the fourth row (e.g., 460) and to the first stage of the fourth shift register (not shown), which is between the fourth row and a subsequent row in implementations having more than four rows. A fourth enable signal (enable_3) goes high to receive the data in the first stage of the fourth shift register (not shown). Thus, following the fourth clock signal (clock 3) and the fourth enable signal (enable_3), the data (Data1) is stored in the fourth shift register (not shown). Additional clock signals and enable signals may be used to copy data to subsequent rows of the display in implementations having additional rows.

In implementations, multiple global clocks can also be used to move the pattern in more than one direction. For example, a "forward" or a "reverse" clock can be used to move the signal one pixel in each of two drive directions. As a further example, a lateral movement clock can be used to move the signal in a diagonal pattern or in a pattern tracking the arbitrary movement of a sample.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. Those of skill in the art will recognize that many of the methods or algorithms set out herein may employ additional acts, may omit some acts, and/or may execute acts in a different order than specified. The various implementations described above can be combined to provide further implementations. All of the commonly assigned U.S. patent application publications, U.S. patent applications, foreign patents, and foreign patent applications referred to in this specification and/or listed in the Application Data Sheet, including but not limited to U.S. Provisional Patent Application No. 62/783,714, filed Dec. 21, 2018, entitled "ADDRESSING FOR EMISSIVE DISPLAYS" are incorporated herein by reference in their entirety.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

What is claimed is:

1. A method for addressing an emissive display having a plurality of pixels arranged into rows and columns, the method comprising:

receiving a first clock signal at an address select input of a first row of the display;

receiving data signals at data signal inputs of the first row of the display, each of the received data signals corresponding to a column of the display;

outputting, when the first clock signal is active at the address select input, the data signals to corresponding drivers of light emitting semiconductors of the first row and via corresponding data signal outputs of the first row;

receiving the data signals from the data signal outputs of the first row at a first row of shift registers;

receiving a second clock signal at the first row of shift registers;

outputting, when the second clock signal is active, the data signals from the first row of shift registers; and receiving the data signals output at corresponding drivers of light emitting semiconductors of a second row of the display.

2. The method of claim 1, further comprising receiving the data signals at one or more non-display buffer rows, each comprising a plurality of shift registers.

3. The method of claim 1, further comprising:

receiving the data signals output from the first row of shift registers at a second row of shift registers;

receiving a third clock signal at the second row of shift registers; and outputting, when the third clock signal is active, the data signals from the second row of shift registers.

4. The method of claim 3, further comprising applying a mathematical function to the data signals prior to the receiving of the data signals at the second row of shift registers.

5. The method of claim 3, further comprising outputting, to external circuitry, the data signals prior to the receiving of the data signals at the second row of shift registers.

6. The method of claim 1, further comprising:

activating a first clock signal communicatively coupled to the address select input;

sending the data signals to the data signal inputs while the first clock signal is active;

deactivating the first clock signal;

activating a first enable signal communicatively coupled to the first row of shift registers to store data from the data signals in the first row of shift registers; and deactivating the first enable signal.

7. The method of claim 6, further comprising:

activating the second clock signal communicatively coupled to the first row of shift registers to output the data signals from the first row of shift registers;

deactivating the second clock signal;

activating a second enable signal communicatively coupled to the second row of shift registers to store the data from the data signals in the second row of shift registers; and deactivating the second enable signal.

8. A system for addressing an emissive display having a plurality of pixels arranged into rows and columns, the system comprising:

a first row of pixels including a plurality of drivers, each driver having a corresponding light emitting semiconductor, the first row being communicatively coupled to receive a first clock signal at an address select input and to receive data signals at data signal inputs, each of the received data signals corresponding to a column of the display, the first row being further communicatively coupled to output, when the first clock signal is active at the address select input, the data signals to corresponding ones of the plurality of drivers and to output the data signals via corresponding data signal outputs of the first row;

a first row of shift registers communicatively coupled to receive the data signals from the data signal outputs of the first row and to receive a second clock signal, the first row of shift registers being further communicatively coupled to output the data signals when the second clock is active; and a second row of pixels including a plurality of drivers, each driver having a corresponding light emitting semiconductor, the second row being communicatively coupled to receive the data signals output from the first row of shift registers at corresponding ones of the plurality of drivers of light emitting semiconductors of the second row of the display.

9. The system of claim 8, further comprising one or more non-display buffer rows communicatively coupled to receive the data signals, each of the non-display buffer rows comprising a plurality of shift registers.

10. The system of claim 8, further comprising a second row of shift registers communicatively coupled to receive the data signals output from the first row of shift registers; to receive a third clock signal; and to output, when the third clock signal is active, the data signals from the second row of shift registers.

11. An addressing system for an emissive display having a plurality of pixels arranged into rows and columns, the system comprising, for each of the columns:

a first thin film transistor (TFT) communicatively coupled to receive a first clock signal at an address select input at a gate of the first TFT and a data signal input at a drain of the first TFT, wherein when the first clock signal is active at the gate of the first TFT, the data signal is passed from the drain of the first TFT to the source of the first TFT;

a second TFT communicatively coupled to receive the data signal from the source of the first TFT at a gate of the second TFT, the second TFT driving a first light emitting semiconductor, in a first row of the display, connected to a drain of the second TFT;

a first shift register comprising at least a third TFT, the first shift register being communicatively coupled to receive the data signal from the source of the first TFT, the first shift register receiving a second clock signal, wherein when the second clock signal is active, the data signal is output by the first shift register; and a fourth TFT communicatively coupled to receive the data signal output by the first shift register at a gate of the fourth TFT, the fourth TFT driving a second light emitting semiconductor, in a second row of the display, connected to a drain of the fourth TFT.

12. The system of claim 11, further comprising:

a second shift register comprising at least a fifth TFT, the second shift register being communicatively coupled to receive the data signal from the first shift register, the second shift register receiving a third clock signal, wherein when the third clock signal is active, the data signal is output by the second shift register; and a sixth TFT communicatively coupled to receive the data signal output by the second shift register at a gate of the sixth TFT, the sixth TFT driving a third light emitting semiconductor, in a third row of the display, connected to a drain of the sixth TFT.

13. The system of claim 11, wherein the first shift register comprises a latch in which the third TFT is communicatively coupled to receive the data signal from the source of the first TFT at a drain of the third TFT; the third TFT is communicatively coupled to receive the second clock signal at a gate of the third TFT; and when the second clock signal is active, the data signal received at the drain of the third TFT is output at the source of the third TFT and output by the first shift register.

14. The system of claim 11, wherein the first shift register comprises a first stage in which the received data signal is input to a source of the third TFT; the data signal is output at a drain of the third TFT to a gate of a seventh TFT when a first enable signal is active at the gate of the third TFT; the gate of the third TFT is connected to a gate of an eighth TFT; and a drain of the seventh TFT and a source of the eighth TFT are connected and output the data signal from the first stage of the first shift register.

15. The system of claim 14, wherein the first shift register further comprises a second stage, in which the data signal received from the first stage of the first shift register is input to a source of a ninth TFT; the data signal is output at a drain of the ninth TFT when the second clock signal is active at a gate of the ninth TFT; the data signal output by the ninth TFT is input to the gate of a tenth TFT; and a drain of the tenth TFT and a source of an eleventh TFT are connected and output the data signal from the first shift register.

16. The system of claim 11, further comprising at least one processor; and at least one non-transitory processor-readable storage medium communicatively coupled to the at least one processor and which stores at least one of processor-executable instructions or data that, when executed by the at least one processor, cause the at least one processor to;

activate a first clock signal communicatively coupled to the address select input;

send the data signal to the data signal input while the first clock signal is active;

deactivate the first clock signal;

activate a first enable signal communicatively coupled to the first shift register to store the data signal in the first shift register; and deactivate the first enable signal.

17. The system of claim 16, wherein the at least one non-transitory processor-readable storage medium further stores at least one of processor-executable instructions or data that, when executed by the at least one processor, cause the at least one processor to:

activate the second clock signal communicatively coupled to the first shift register to output the data signal from the first shift register;

deactivate the second clock signal;

activate a second enable signal communicatively coupled to the second shift register to store the data signal in the second shift register; and deactivate the second enable signal.

18. A method for addressing an emissive display having a plurality of pixels arranged into rows and columns, the method comprising, for each of the columns:

receiving a first clock signal at an address select input at a gate of a first thin film transistor (TFT) and a data signal input at a drain of the first TFT, wherein when the first clock signal is active at the gate of the first TFT, the data signal is passed from the drain of the first TFT to the source of the first TFT;

receiving the data signal from the source of the first TFT at a gate of a second TFT, the second TFT driving a first light emitting semiconductor, in a first row of the display, connected to a drain of the second TFT;

receiving the data signal from the source of the first TFT at a first shift register comprising at least a third TFT, the first shift register receiving a second clock signal, wherein when the second clock signal is active, the data signal is output by the first shift register; and receiving the data signal output by the first shift register at a gate of a fourth TFT, the fourth TFT driving a second light emitting semiconductor, in a second row of the display, connected to a drain of the fourth TFT.

19. The method of claim 18, further comprising:

receiving the data signal from the first shift register at a second shift register comprising at least a fifth TFT, the second shift register receiving a third clock signal, wherein when the third clock signal is active, the data signal is output by the second shift register; and receiving the data signal output by the second shift register at a gate of a sixth TFT, the sixth TFT driving a third light emitting semiconductor, in a third row of the display, connected to a drain of the sixth TFT.

20. The method of claim 18, further comprising:

activating a first clock signal communicatively coupled to the address select input;

sending the data signal to the data signal input while the first clock signal is active;

deactivating the first clock signal;

activating a first enable signal communicatively coupled to the first shift register to store data from the data signal in the first shift register; and deactivating the first enable signal.

21. The method of claim 20, further comprising:

activating the second clock signal communicatively coupled to the first shift register to output the data signal from the first shift register;

deactivating the second clock signal;

activating a second enable signal communicatively coupled to the second shift register to store the data from the data signal in the second shift register; and deactivating the second enable signal.

22. The method of claim 18, further comprising:

inputting the received data signal to a source of the third TFT, in a first stage of the first shift register; and outputting the data signal at a drain of the third TFT to a gate of a seventh TFT when the first enable signal is active at the gate of the third TFT, the gate of the third TFT being connected to a gate of an eighth TFT, wherein a drain of the seventh TFT and a source of the eighth TFT are connected and output the data signal from the first stage of the first shift register.

23. The method of claim 22, further comprising:

inputting the data signal received from the first stage of the first shift register to a source of a ninth TFT, in a second stage of the first shift register; and outputting the data signal at a drain of the ninth TFT when the second clock signal is active at a gate of the ninth TFT, the data signal output by the ninth TFT being input to the gate of a tenth TFT, wherein a drain of the tenth TFT and a source of an eleventh TFT are connected and output the data signal from the first shift register.

* * * * *